US005887416A

United States Patent [19]

Shimono et al.

[11] Patent Number: 5,887,416

[45] Date of Patent: Mar. 30, 1999

[54] RENTAL MAT

[75] Inventors: Kikuo Shimono; Yuji Nagahama, both of Suita, Japan

[73] Assignee: Duskin Co., Ltd., Osaka, Japan

[21] Appl. No.: 970,093

[22] Filed: Nov. 13, 1997

[30] Foreign Application Priority Data

Feb. 14, 1997 [JP] Japan ..... 9-030143

[51] Int. Cl.[6] ..... D02G 3/02

[52] U.S. Cl. ..... 57/236; 57/211; 57/237; 57/238; 428/88; 428/89; 428/92; 428/97

[58] Field of Search ..... 57/211, 236, 237, 57/238, 243, 244; 15/215, 238; 52/660; 428/88, 89, 92, 97

[56] References Cited

U.S. PATENT DOCUMENTS

| | | | |
|---|---|---|---|
| 2,571,087 | 10/1951 | Underwood et al. | 57/238 |
| 2,955,346 | 10/1960 | Walmsley | 57/237 |
| 3,011,243 | 12/1961 | Herrnstadt | 57/238 |
| 3,940,522 | 2/1976 | Wessells | 428/17 |
| 4,340,631 | 7/1982 | Endo et al. | 428/89 |
| 5,652,038 | 7/1997 | Geren | 428/92 |
| 5,786,083 | 7/1998 | Harris | 57/210 |

*Primary Examiner*—William Stryjewski

*Attorney, Agent, or Firm*—Evenson, McKeown, Edwards & Lenahan, P.L.L.C.

[57] ABSTRACT

A rental mat in which a pile yarn is tufted onto a base cloth and the total or a part of pile shape is a cut pile. The pile yarn is composed of one BCF nylon twist yarn and one or more nylon monofilament single yarns. The BCF nylon twist yarn and the nylon monofilament single yarns are tufted as one pile yarn under a state of being twisted each other, and are separated and isolated respectively from the twisted state at a part of the cut pile on a mat surface.

1 Claim, 2 Drawing Sheets

RENTAL MAT

BACKGROUND OF THE INVENTION

This invention relates to a rental mat, in which a pile yarn is tufted onto a base cloth and the total or a part of pile shape is a cut pile.

A conventional rental mat, in which a pile yarn is tufted onto a base cloth and the total or a part of pile shape is a cut pile, is roughly classified into two categories: outdoor type and indoor type. The outdoor mat is required to provide a brushing force in order to remove a great quantity of dust including comparatively large grain size, or to remove dust efficiently from rough shoe soles. Therefore, the pile yarn is composed of a nylon monofilament twist yarn consisting of thick nylon monofilament single yarns. An artificial grass is a typical example of it. Since the indoor mat is required to provide a high holding ability of moisture and dust, its pile yarn is composed of a balked continuous fiber (abbreviated to BCF hereunder) nylon twist yarn consisting of thin BCF nylon single yarns. FIG. 4 is a vertical sectional partial view of a conventional indoor mat. A BCF nylon twist yarn 1 for use in the pile yarn is secured to a rubber sheet 3 in such a manner that it is tufted to a base cloth 2 and fixed by a bonding agent such as a latex 4 on a non-piled surface as occasion demands. This is called as an integral type. The total or a part of the pile yarn has a shape of cut-pile. FIG. 4 shows the cut-pile only.

Generally, the BCF nylon twist yarn is formed by twisting two to four BCF nylon temporary twist yarns. One BCF nylon temporary twist yarn most generally used consists of sixty-eight BCF nylon single yarns and a thickness of one BCF nylon single yarn frequently used is about 20 deniers. On the other hand, the nylon monofilament twist yarn is formed by twisting about several to ten nylon monofilament single yarns, and a thickness of one nylon monofilament single yarn is about 200 to 500 deniers. Generally, a thickness of the BCF nylon single yarn is 5 to 80 deniers and that of the nylon monofilament single yarn is 100 to 1,000 deniers.

The outdoor mat and indoor mat have included the following merits and demerits respectively. The outdoor mat has provided a large brushing force to produce a great dust removing effect, because each nylon monofilament twist yarn has been stiff and standing upright. However, variation of color pattern of produced colored pile yarn has been limited to a small range and a touch of fabric has not been changed, so that the mat has been unable to meet demands of customer. Since a specific surface area of one nylon monofilament twist yarn has been small due to thickness of one nylon monofilament single yarn, it has been inevitable to increase a weight of pile yarn used per unit area in order to give clear color pattern to the mat, so that its cost has been increased.

On the other hand, the indoor mat has provided an excellent holding ability of moisture and dust and realized a variety of color owing to the BCF nylon twist yarn differing from the nylon monofilament twist yarn, so that it has been able to meet demands of customer satisfactorily. However, the BCF nylon twist yarn has been soft and its revealed cut section of twist yarn has been released from the twisted state, so that tip end of the cut section has been separated and opened. Therefore, it has been difficult to enhance the brushing ability and the dust removing effect has been small.

For this reason, it has become required to produce a mat making up its demerits and making use of its merits, and further to produce a mat suitable for use in an intermediate application of both indoor and outdoor purposes. An object of this invention is to provide such a mat.

BRIEF SUMMARY OF THE INVENTION

In order to accomplish the above object, a rental mat of this invention, in which a pile yarn is tufted onto a base cloth and the total or a part of pile shape is a cut pile; the improvement wherein the pile yarn is composed of one BCF nylon twist yarn and one or more nylon monofilament single yarns, the BCF nylon twist yarn and the nylon monofilament single yarn are tufted as one pile yarn under a state of being twisted each other, and they are separated and isolated respectively from the twisted state at a part of the cut pile on a mat surface.

DETAILED DESCRIPTION OF THE INVENTION

Figure 1:
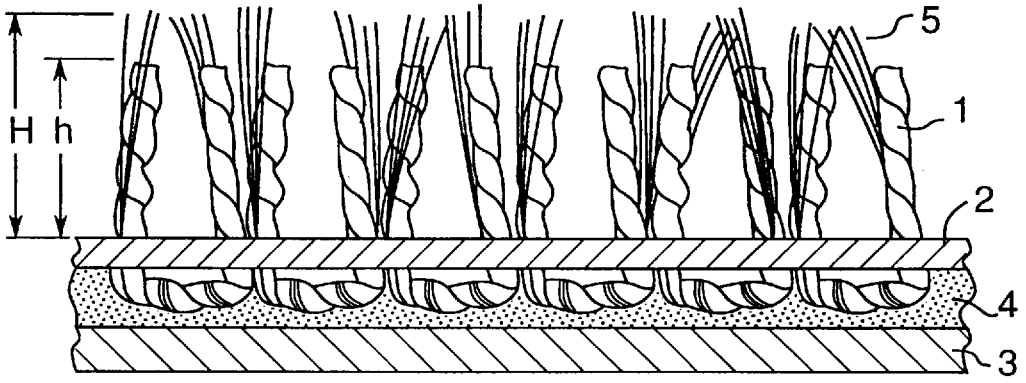
FIG. 1 is a vertically sectional partial view of a rental mat of this invention.
Figure 4:
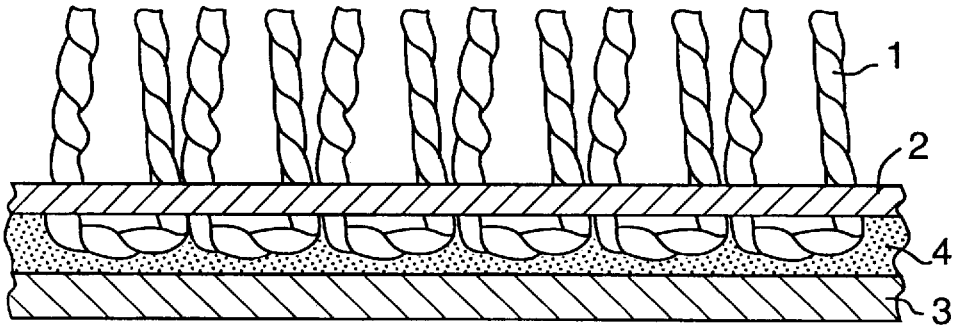
FIG. 4 is a vertically sectional partial view of a conventional indoor rental mat.

FIG. 1 is the vertically sectional partial view of the rental mat of this invention. In the figure, symbols same as those of FIG. 4 represent the same or equivalent components. In this mat, a BCF nylon twist yarn 1 and a nylon monofilament single yarn 5 are tufted onto the identical spot. The both are tufted as one pile yarn under a state of being twisted each other. However, on the mat surface, the BCF nylon twist yarn 1 and the nylon monofilament single yarn 5 are separated and isolated each other from the twisted state at the cut pile part. The nylon monofilament single yarn 5 becomes straight upright from the twisted state owing to its stiffness, so that its height H is larger than a height h of the BCF nylon twist yarn 1.

Figure 2:
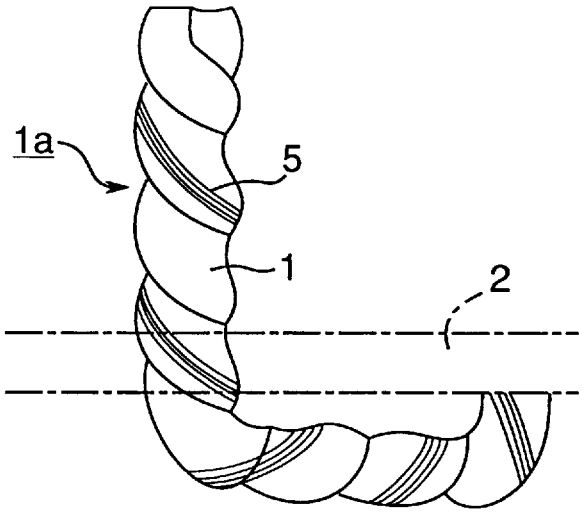
FIG. 2 is an enlarged partial view showing a pile yarn immediately after being subjected to tufting and cut piling.
Figure 3:
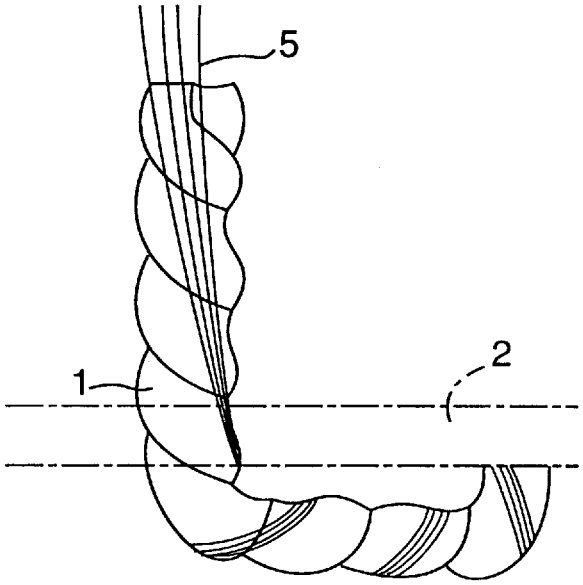
FIG. 3 is an enlarged partial view showing a pile yarn after a state where the pile yarn under the state of FIG. 2 is washed.

The mat having the above-mentioned structure is manufactured in the following manner. In the first stage, the BCF nylon single yarn is subjected to a first twist to make up a BCF nylon temporary twist yarn, and two BCF nylon temporary twist yarns are subjected to a final twist in a direction opposite to that of the first twist to make up one BCF nylon twist yarn 1. In the second stage, one BCF nylon twist yarn 1 and four nylon monofilament single yarns 5 are further twisted in a direction opposite to that of the final twist of the BCF nylon twist yarn 1 and thermally set under wet heat for one to five minutes at 120° C. to 130° C., so that one pile yarn la is made up. In the third stage, the pile yarn 1*a* is tufted onto a base cloth 2 by a tufting machine, the total or part of it is subjected to a cut piling, and then the pile yarn 1*a* is fixed by a bonding agent such as a latex 4 onto a non-piled surface of the base cloth 2. The pile yarn 1*a* tufted onto the base cloth 2 is secured to a rubber sheet 3. FIG. 2 is the enlarged partial view showing the pile yarn 1*a* on the mat immediately after being subjected to the tufting and cut piling, and the pile yarn 1*a* is under a state where one BCF nylon twist yarn 1 and four nylon monofilament single yarns 5 are twisted each other. By washing the pile yarn 1*a* tufted onto the base cloth 2 after being secured to the rubber sheet 3, however, the nylon monofilament single yarn 5 becomes straight upright from the twisted state owing to its stiffness as illustrated in FIG. 3. In this manner, the rental mat shown in FIG. 1 can be obtained.

In the foregoing manufacturing process, since the nylon monofilament single yarn 5 becomes straight upright from the twisted state by being washed, a twist-releasing torque accumulated in the nylon monofilament single yarn 5 immediately after the tufting is released without giving influence on the BCF nylon twist yarn 1. Therefore, the cut end section of the BCF nylon twist yarn 1 is not opened by the twist-releasing torque of the nylon monofilament single yarn 5. Accordingly, it becomes possible for the rental mat of FIG. 1 to maintain its stable appearance for a long period.

In the mat having the above structure, the BCF nylon twist yarn 1 and the nylon monofilament single yarn 5 exist on the mat surface independently from each other. Therefore, it becomes possible to make use of merits of the conventional outdoor mat composed only of the nylon monofilament twist yarn and the conventional indoor mat composed only of the BCF nylon twist yarn, and it becomes possible to compensate for demerits of the both. Namely, a holding ability of moisture and dust similar to those of the conventional indoor mat and an excellent brushing force can be provided, and its holding ability of moisture and dust can be improved as compared with that of the conventional outdoor mat although its brushing force is a little inferior to the conventional mat. Accordingly, a property suitable for use in an intermediate application for both outdoor and indoor purposes can be acquired. Further, the BCF nylon twist yarn 1 can provide a large variety of color as compared with the conventional outdoor mat, so that the mat of this invention will give possibility to meet demands of customer moreover.

In addition, since the nylon monofilament single yarns 5 extend straight from the closely tufted BCF nylon twist yarns 1 and protrude from the BCF nylon twist yarns 1 on the mat surface, a stereo design effect can be provided owing to the above feature. When the nylon monofilament single yarn 5 is not colored, only the brushing force can be added without giving affect on the color pattern owing to the BCF nylon twist yarn 1. When the nylon monofilament single yarn 5 is colored, the design effect of the BCF nylon twist yarn 1 can be enhanced.

Further, the nylon monofilament single yarn 5 protrudes from the BCF nylon twist yarn 1 at the mat surface so as to create a height difference between them, so that the brushing force against rough shoe soles can be improved.

In the above description, the number of the used nylon monofilament single yarn 5 is not necessarily limited to four, but may be any number of one or larger. The brushing force and the design effect can be controlled by adjusting the number of the nylon monofilament single yarn 5.

An embodiment and a comparison example will be shown hereunder together with their test procedures and test results.

(Embodiment)

Pile yarn
- BCF nylon
  - Total denier: 1,300 deniers
  - Single yarn denier: 19 deniers
- Number of twist
  - First twist: 180 times/m, S-twist
  - Final twist: 180 times/m, Z-twist
- Nylon monofilament
  - Single yarn denier: 325 deniers The BCF nylon of 1,300 deniers yarn was subjected to the first twist, and two resulted yarns were subjected to the final twist to make up the BCF nylon twist yarn. Then, four nylon monofilament single yarns were twisted to the BCF nylon twist yarn with 50 times/m in S-direction and thermally set at 125° C. for two minutes. Thus, a pile yarn to be tufted was made up.

Other conditions
- Stitch: 6 pcs.inch
- Gauge: 32 pcs.5 inches
- Pile length: 9 mm
- Pile density: 1,320 g/m$^2$
- Pile shape: Cut pile
- Base cloth
- Polyester non-woven fabric: 150 g/m$^2$ (COMPARISON EXAMPLE)

Pile yarn
- BCF nylon
  - Total denier: 1,300 deniers
  - Single yarn denier: 19 deniers
- Number of twist
  - First twist: 180 times/m, S-twist
  - Final twist: 180 times/m, Z-twist The BCF nylon of 1,300 deniers yarn was subjected to the first twist, and two resulted yarns were subjected to the final twist. Thus, a BCF nylon twist yarn to be tufted was made up.

Other conditions
- Stitch: 6 pcs./inch
- Gauge: 32 pcs./5 inches
- Pile length: 9 mm
- Pile density: 880 g/m$^2$
- Pile shape: Cut pile
- Base cloth
- Polyester non-woven fabric: 150 g/m$^2$ (Test)

The mat original clothes made up according to the foregoing embodiment and the comparison example were cut to 70cm-wide and 85cm-long sheet, and placed on 2 mm thick unvulcanized NBR rubber sheets. They were pressed for 15 minutes at 170° C. with a pressure of 8 kg/cm$^2$ to be subjected to a bonding vulcanizing press, so that integral mats were made up.

These mats were place on a road passed by about 3,000 persons per day for three days, and subjected to ordinary washing retreatments for rental mat. Measurements of dust adhering to shoe soles of passersby were done on mats subjected to the washing retreatment once and twenty times respectively, and dust carry-in rates were calculated. Results are listed in Table 1. The dust carry-in rate is a value calculated by dividing a dust quantity remaining on shoe sole by a dust quantity adhering to the mat, after the mat is trodden. Here, the rates were calculated from mean value of 100 passersby.

TABLE 1

| | One-time washing retreatment | 20-times washing retreatment |
|---|---|---|
| Embodiment | 9.8% | 8.7% |
| Comparison example | 25.5% | 24.8% |

As obvious from Table 1, according to the embodiment i.e. the mat of this invention, the rough surfaces of shoe soles could be brushed efficiently. Further, the mat could be used without impairing its ability even after being subjected to the washing retreatment repeatedly.

As described above, the mat of this invention has the holding ability of moisture and dust similar to that of the conventional indoor mat, and provides an excellent brushing force. It is a little inferior in its brushing force to the conventional outdoor mat, but it is excellent in its holding ability of moisture and dust as compared with the conventional one. For this reason, this mat can be effectively used for an intermediate application of both outdoor and indoor purposes.

Moreover, the BCF nylon twist yarn can give the mat a possibility of changing its color, so that it can meet demands of customer as compared with the conventional outdoor mat.

Furthermore, since the nylon monofilament single yarns extend straight from the closely tufted BCF nylon twist yarns and protrude from the BCF nylon twist yarns, the stereo design effect can be provided.

In addition, the height difference is created between the nylon monofilament single yarn and the BCF nylon twist yarn at the mat surface, so that the brushing force against the rough shoe soles can be improved.

We claim:

1. A rental mat, in which a pile yarn is tufted onto a base cloth and the total or a part of pile shape is a cut pile;

the improvement wherein the pile yarn is composed of one BCF nylon twist yarn and one or more nylon monofilament single yarns, and the BCF nylon twist yarn and the nylon monofilament single yarns are tufted as one pile yarn under a state of being twisted each other, and are separated and isolated respectively from the twisted state at a part of the cut pile on a mat surface.

* * * * *